US005708979A

United States Patent [19]

Redwood et al.

[11] Patent Number: 5,708,979

[45] Date of Patent: Jan. 20, 1998

[54] GLOVE WITH ELASTIC BACK

[75] Inventors: Michael Redwood, Somerset, Great Britain; Kenneth Shim, Irvington, N.Y.; Dong Kyu Sun, Yong-In Kun Kyong Ki Do, Rep. of Korea

[73] Assignee: Acushnet Company, Fairhaven, Mass.

[21] Appl. No.: 742,530

[22] Filed: Nov. 1, 1996

[51] Int. Cl.[6] ..... A41D 19/00; A63B 71/14

[52] U.S. Cl. ..... 2/161.1; 2/161.2; 2/167

[58] Field of Search ..... 2/16, 158, 159, 2/161.1, 161.2, 161.3, 161.4, 161.6, 163, 164, 167; D2/619

[56] References Cited

U.S. PATENT DOCUMENTS

| | | | |
|---|---|---|---|
| D. 336,562 | 6/1993 | Chin | D2/619 |
| D. 340,793 | 11/1993 | Autier | D2/619 |
| 3,123,832 | 3/1964 | Kubik | 2/161 |
| 3,703,007 | 11/1972 | Stewart | 2/163 |
| 4,700,405 | 10/1987 | Sternberg | 2/161 |
| 4,701,963 | 10/1987 | Overton | 2/161 |
| 4,843,651 | 7/1989 | Gramza | 2/917 |
| 4,864,659 | 9/1989 | Morris | 2/163 |
| 5,195,188 | 3/1993 | Bourdeau et al. | 2/161 |
| 5,345,609 | 9/1994 | Fabry et al. | 2/20 |
| 5,390,372 | 2/1995 | Hashimoto et al. | 2/164 |
| 5,528,773 | 6/1996 | Lowingwer | 2/161.4 |

*Primary Examiner*—C.D. Crowder
*Assistant Examiner*—Larry D. Worrell, Jr.
*Attorney, Agent, or Firm*—Pennie & Edmonds LLP

[57] ABSTRACT

A glove having a palm covering portion, a plurality of finger covering portions extending from the palm covering portion to receive and cover fingers, a back portion associated with the palm covering portion to form a chamber to receive a hand, and elastic members extending from the back portion past and over at least one knuckle of each finger, each elastic member being associated with a finger covering portion to allow stretching of the finger covering portions when the finger is bent.

22 Claims, 8 Drawing Sheets

GLOVE WITH ELASTIC BACK

FIELD OF THE INVENTION

The present invention relates to a glove that is designed to fit snugly on a user's hand, while also being sufficiently flexible to allow both static and dynamic hand positions and movement. This glove is particularly useful as a glove for golf, baseball, football, other sports, or the like.

BACKGROUND OF THE INVENTION

There are numerous gloves which appear in the art. Of those, the following patents describe those which appear to have a hand back that contains at least two different materials visible to the wearer.

U.S. Pat. Design No. 336,562 depicts the ornamental design for a sport glove that contains one material that runs up the back of the hand and onto the back of the entire middle and ring fingers. A different material appears to cover the back of the index and pinkie fingers.

U.S. Pat. Design No. 340,793 depicts the ornamental design for a golfing glove that contains one material with gridlike appearance that covers the back of the hand and the entire pinkie and ring fingers. A different material with perforations appears on the back of the thumb, index and middle fingers.

U.S. Pat. No. 3,123,832 discloses a bowling glove having a stiffening member that extends from the wrist band down to the fingers of the glove or slightly short thereof and is disposed medially of the glove. The stiffener is either secured directly to the back surface as by stitching or a suitable adhesive, for example. The stiffener is preferably elastic or resilient material capable of a two-way stretch so as to cause the glove to inherently tend to contract on the hand and thus fit snugly, as well as to impart stiffness or tension across the back of the hand to stiffen the fingers.

U.S. Pat. No. 4,701,963 discloses a glove with dual attaching straps, one of which extends across stretchable material forming a portion of the back side of the glove. This strap tends to pull and gather the back side of the glove, resulting in a snug and secure fit. Also disclosed is a stretchable type material such as nylon that is inserted in the backside of the glove and extends along segmented portions on the sides of the fingers.

U.S. Pat. No. 5,195,188 discloses a sports glove that includes a tightening strap to preserve easy insertion of the hand without special glove readjustment, to adapt to a larger number of different anatomical features and to better distribute the tightening force. The phalangeal region contains small forks on the sides of the fingers that may be formed from a highly extensible and elastic materials, preferably elasthane-based textiles. Also disclosed is an embodiment where the forks are made of a material possessing slight extensibility, such as leather, and the remaining areas are made of an extensible, elastic material.

U.S. Pat. No. 5,345,609 discloses a protective glove having at least one pocket with one or more hollow, fluid-filled shock-absorbing cells disposed therein. The cells are covered by inner and outer panels made of elastic fabric, which cooperates to form a closed pocket for a resilient, protective cellular material. The resilient panel holds the cellular material snugly in position, is cut in substantially the same shape as the cellular material, and is superimposed therewith so its edges are curled around and under the edges of cellular material.

Conventional gloves typically do not permit sufficient flexibility in the fingers to perform various sports movements, such as swinging a racquet, bat, or golf club, while maintaining a tight fit in the fingers. Many gloves that have some degree of flexibility in the fingers often do so by use of a thin material that disadvantageously wears through over a short time period. The present invention provides a new glove structure which overcomes these disadvantages.

SUMMARY OF THE INVENTION

The present invention relates to a glove comprising a palm covering portion, a plurality of finger covering portions extending from the palm covering portion to receive and cover fingers, a back portion associated with the palm covering portion to form a chamber to receive a hand, and elastic members extending from the back portion past and over at least one knuckle of each finger, each elastic member being associated with a finger covering portion to allow stretching of the finger covering portion when the finger is bent. In a preferred embodiment of the invention, each elastic member has a length that extends past two knuckles of each finger. In another preferred embodiment, each elastic member has a width that is less than that of the fingers.

The materials used in the glove are an important part of the invention. In one embodiment, the palm and finger covering portions are each made of a non-woven material. In a preferred embodiment, the non-woven material is suede, leather or a synthetic material. In another preferred embodiment, the non-woven leather material of the palm and finger portions is a patterned leather, such as PITTARDS DIGITAL LEATHER®. In one embodiment, the non-woven material of each finger covering portion contains a plurality of perforations to enhance breathability of the glove. In a preferred embodiment, the back portion is made of an elastic material. In another preferred embodiment, the elastic material of the back portion and the elastic members are each a mesh. In yet another preferred embodiment, the elastic material of the back portion and the elastic members are each a material capable of two-way stretch.

In another embodiment of the invention, the glove further includes a thumb covering portion and an elastic member associated therewith to allow stretching of the thumb covering portion when the thumb is bent. The materials of various parts of the invention may be joined or configured in various combinations. In one embodiment, the palm and finger covering portions are made of a single piece of material. In another embodiment, the back portion and elastic members are made of a single piece of stretchable material. In yet another embodiment, the back portion includes a slit to facilitate insertion of a hand. In another embodiment, the back portion includes a closure member to close the slit after insertion of the hand. In another embodiment, the closure member is made of a non-woven material and includes an indicia thereon.

Various optional performance and comfort enhancing materials may be included in the present invention. In one embodiment, the elastic material may include a satin backing. In another embodiment, the elastic material includes a temperature controlling material for additional comfort. In yet another embodiment, the elastic material includes a waterproofing membrane. In another embodiment, the elastic material includes a wicking material to absorb perspiration.

Other preferred features of the glove are as follows. In one embodiment, the finger covering portions include an open area between adjacent finger covering portions. In another embodiment, the palm covering portion surrounds the thumb covering portion. In yet another embodiment, the glove further includes a stretchable wrist band associated with the palm covering portion.

DETAILED DESCRIPTION OF THE INVENTION

Figure 1:
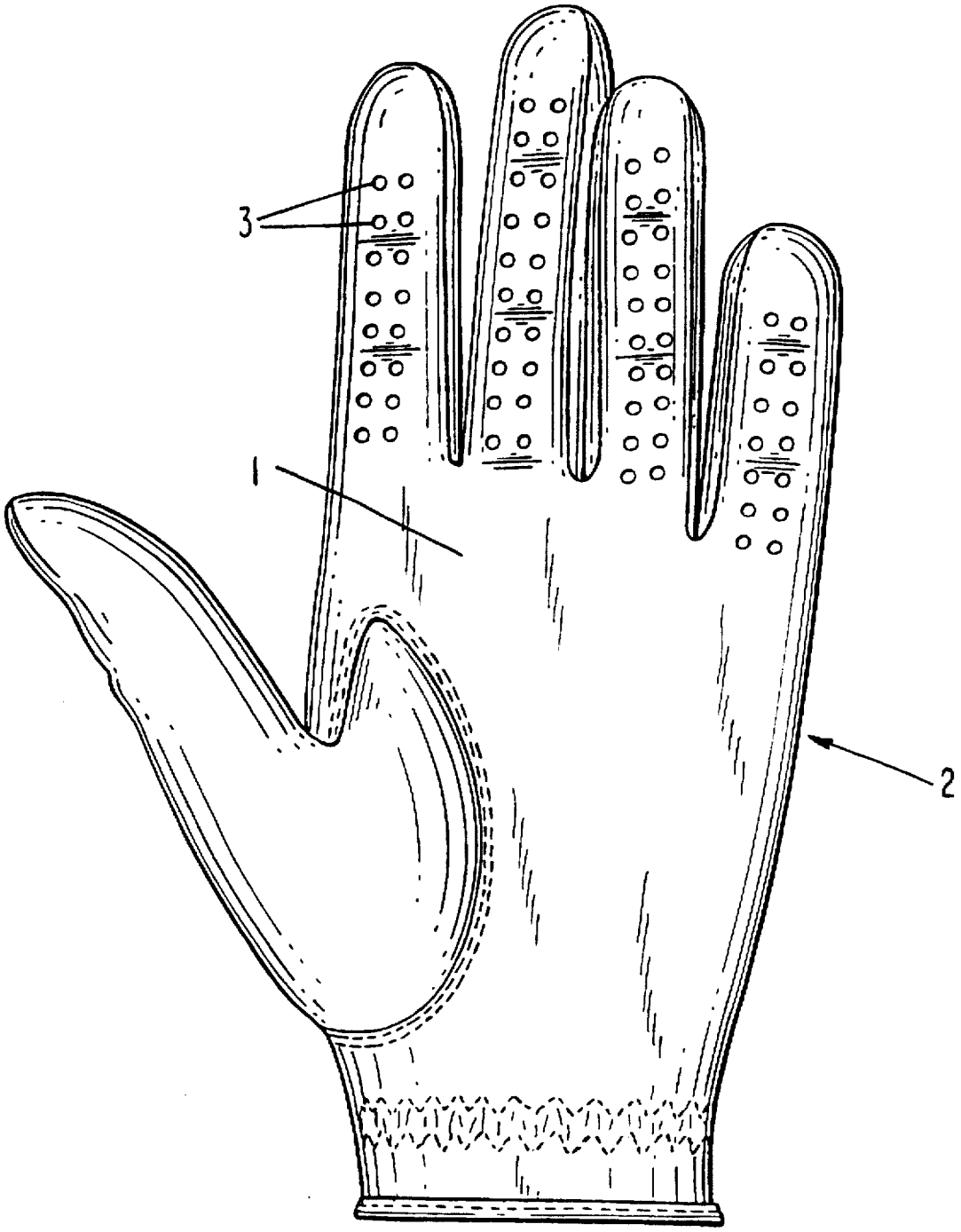
FIG. 1 is a front view of a first embodiment of a glove according to the invention, showing one type of leather material.

The present invention advantageously provides a glove that fits snugly and tightly around the user's hand in a comfortable manner. The balance of construction and materials with the static and dynamic nature of hand movements assures a more durable and resilient fit. The glove of the present invention is effectively skin tight, an effect substantially present throughout its life span. This advantage is due to the unique design and combination of construction materials described below, which provide a desirable comfort, fit, and wear resistance in one glove that has not been achieved prior to now.

The snug, comfortable fit of the present invention is provided by use of a strong elastic material across substantially the entire back of the hand. When combined with a hook and loop type closure, this arrangement provides a more accommodating fit on first use and allows the glove to adjust as the palm material expands. Extensive wear trials have shown that the palm never becomes loose. This same concept has been extended to the back of the fingers and thumb, as well.

The present invention also has a peninsula-like formation of elastic material extending along the finger portions, preferably past and over the first knuckle, and most preferably along substantially the entire length of the finger over the knuckle. The material extending along the finger portions provides a tight fit in the fingers of the glove, a particular problem in the prior art especially at the knuckles and after extensive wear. Various athletes, golfers in particular, intensely dislike loose fingers in their gloves. The present invention provides a tight finger fit across substantially the entire finger by permitting a wearer to bend her finger and have the elastic material stretch over the knuckle, providing a fit which preferably lasts for substantially the entire life of the glove while still permitting hand adjustment. This results in a glove that is not bulky or cumbersome, and has a better "feel" when gripping objects. A variety of finger thicknesses may be accommodated, as well.

The elastomeric, or elastic material, used is preferably a one-way stretch material, and more preferably a two-way stretch material. The elastic material may be disposed in the glove to provide stretch in various directions, but it preferably provides at least thumb to pinkie stretch across the back of the wearer's hand. In the fingers, it is preferred that a one-way elastic material stretch lengthwise down the finger over the knuckle as the finger is bent, although a one-way material that stretches across each knuckle also provides a suitable glove fit. The elastic material preferably breathes to decrease the sweatiness and possible overheating of an athlete's hands in the glove. The material is preferably a mesh to provide an enhanced snug fit, more preferably an elasticated mesh. The most preferred embodiment uses elasticated mesh G6™, which has a controlled 2-way stretch combination of nylon and polyester and is available from Avon Tape, Inc., 46 N. Montello Street, Brockton, Mass. 02403.

The G6™ elasticated mesh includes about 66 percent polyamide and 34 percent rubber, and has a density of about 340.0 g/m$^2$(±5%). The dimensional stability after washing at 50° C. is about 5 percent length and about 10 percent width. The stretch to dinamometer instron at about 5 kg is about 170 percent in length (±10%) and about 150 percent in width (±10%). The hand elongation is about 175 percent in length (±10%) and about 145 percent in width (±10%). G6 has aggressive stretch characteristics that do not substantially degrade with wear.

In another embodiment, the elastic material is G8™, a 2-layer 1-way stretch satin-backed material, also available from Avon Tape, Inc. This smooth material enhances the smoothness of the glove against the hand, but has worse wear characteristics and feels more loose in the palm and fingers compared to the most preferred embodiment.

The use of the elastic materials of the present invention along the fingers to provide enhanced fit permits use of a stiffer, more wear resistant material to construct the remainder of the glove than was possible in the prior art. A non-woven material is preferably used for the glove back, as well as the front, although the specific materials may be independently selected.

In one preferred embodiment, leather is used to provide good wear resistance while still providing good "feel." The elastic mesh permits use of a fairly stiff leather having good wear resistance qualities. In another embodiment, synthetic materials may be used which are well known to one skilled in the art and provide similar characteristics to those of leather. In another embodiment, the leather used has been modified to provide a surface appearance having a continuous pattern of smooth grain and discontinuous roughened areas. This modification provides improved grip characteristics under certain conditions and facilitates removal of liquids, such as water, from the surface. There are numerous means of achieving this effect, which are well known to those who skilled in this art. Such a product is available from Pittards plc, Sherborne Road, Yeovil, Somerset BA21 5BA, Great Britain. Other suitable non-woven materials include simulated (artificial) leather, deerskin, doeskin, steer hide, nylon, nylon-acrylic, neoprene, terrycloth, and the like.

The glove of the present invention additionally has a striking design—the skeletal pattern of the hand. The elastomeric material that extends along the finger portions is preferably shaped to overlay the bones of the wearer's hand.

FIG. 1 is a front view of a first embodiment of a glove according to the invention. The non-woven material in this embodiment is one type of leather material 1, as depicted in this left-handed glove 2. The non-woven material covers the palm and a portion of each finger. Although drawn as a single piece, the glove fingers can be made as separate pieces, which are sewn or otherwise joined to the portion that covers the wearer's palm. The fingers of the front of the glove preferably contain a plurality of perforations 3 to permit breathability of wearer's hand, thereby reducing sweatiness and overheating. Although not depicted, the glove may include an open area in any or all of the finger covering portions that are between adjacent finger covering portions, i.e., in the notch between any two given fingers. This open area assists with both fit, flexibility, and breathability.

Figure 2:
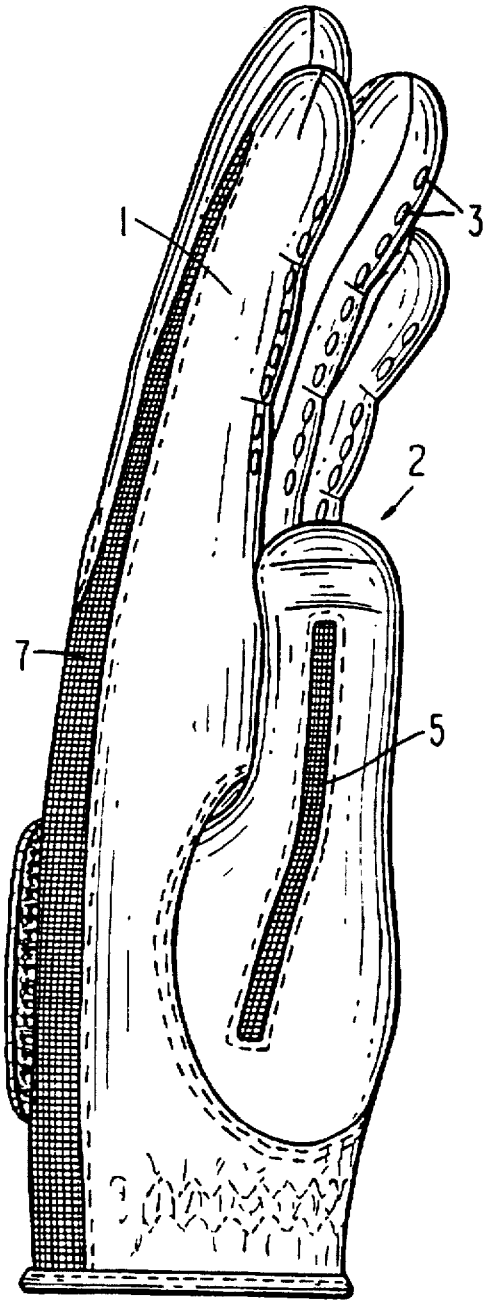
FIG. 2 is a left side view thereof.
Figure 3:
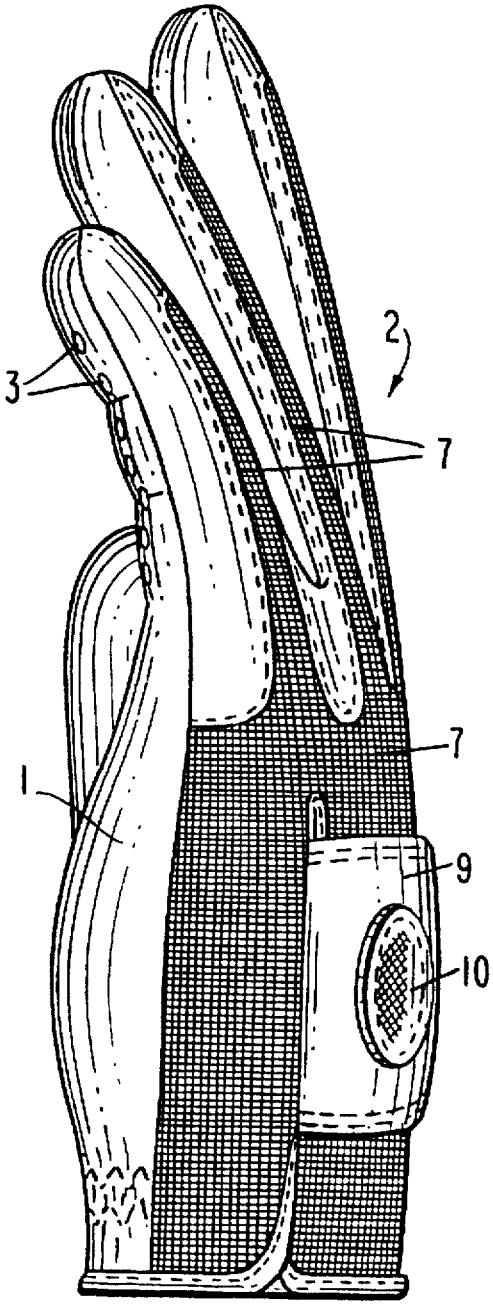
FIG. 3 is a right side view thereof.

FIGS. 2 and 3 are a side views of the glove 2, showing the non-woven front material 1 with optional perforations 3. On the back side of the glove can be seen the elastic material 7, which in FIG. 2 is also seen to extend along the thumb portion 5 of the glove. The figures clearly indicate the gridlike nature of the elastic material in this embodiment. The openings between the mesh permit breathability of the wearer's hand, thereby decreasing sweatiness and overheating. While an athlete is wearing the glove, the mesh may expand to provide a tight fit. Such mesh expansion typically occurs when the wearer fastens the back of the glove using the hook and loop fastener or when the wearer's fingers are flexed. This mesh expansion permits the perforations to expand in size, enhancing the breathability of the glove in the process. In FIG. 3, a tab for a hook and loop-type closure 9 may contain an optional logo 10 having lettering such as "THE BONE by TITLEIST" or some other personalized lettering. FIG. 3 further shows the elastic material 7 extending across substantially the entire back of the hand and extending along substantially all of the finger portions.

Figure 4:
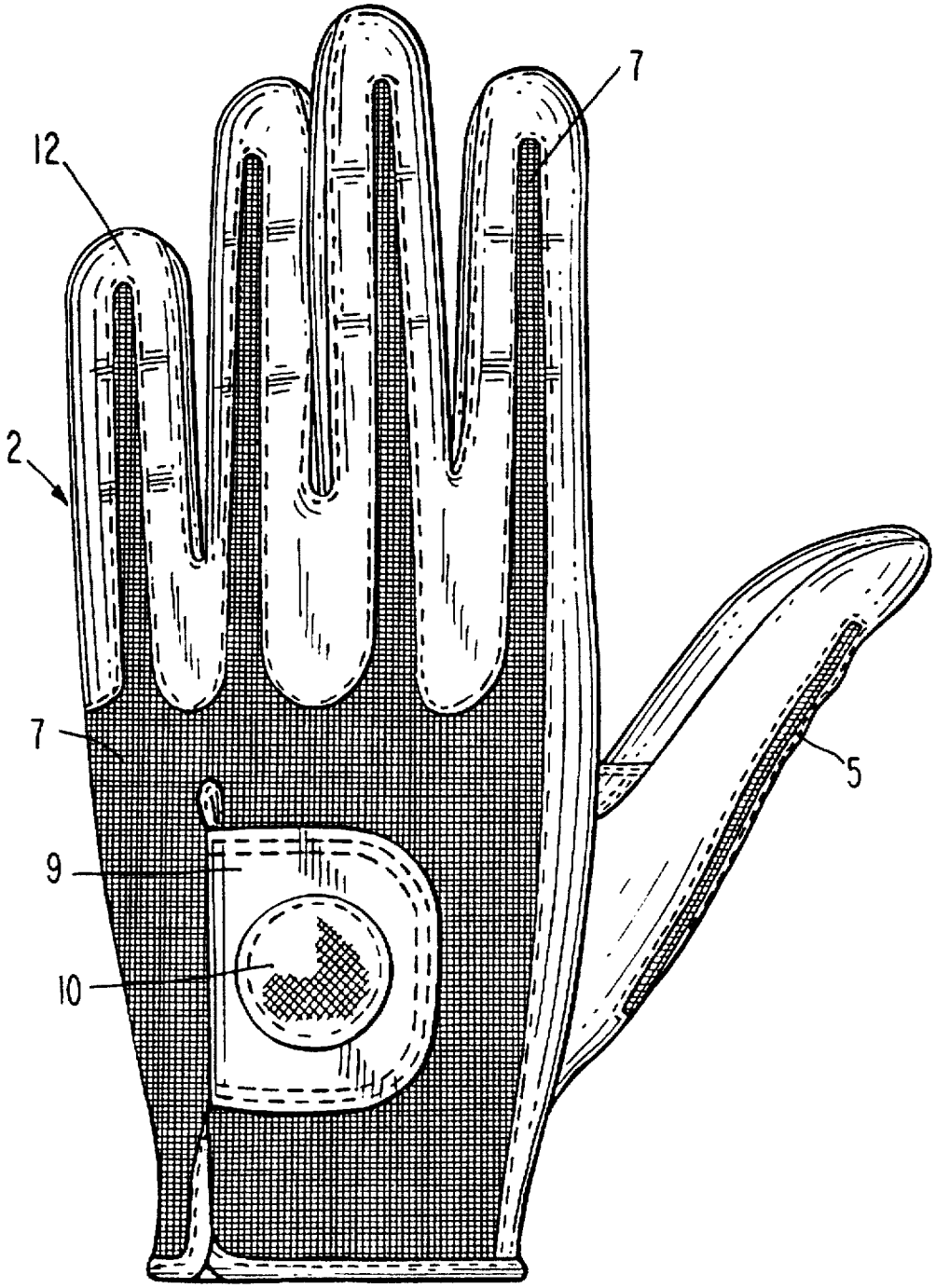
FIG. 4 is a rear side view thereof.

FIG. 4 depicts the back of the glove, with the elastic material 7 extending across substantially the entire back of the hand and extending along substantially all of the finger portions. The elastic material has a width that is less than that of the back of the hand, as well as less than that of the fingers. In combination with the finger covering portions, this provides a hand cavity for the hand to be inserted. Thus, the glove fits snugly thereon when a hand and fingers are inserted. A slit may be present in the palm portion or back portion of the glove, for simplifying insertion of the wearer's hand into the glove. Across this slit, a hook and loop-type closure 9, with optional lettering 10, or indicia, is preferably added to fasten the glove firmly together to prevent slippage of the glove once placed on the hand. The non-elastic material on the glove back is preferably a non-woven material 12. In a most preferred embodiment, this material 12 is leather. In another preferred embodiment, this material 12 is PITTARDS DIGITAL LEATHER®. PITTARDS DIGITAL LEATHER® has the appearance of fake or artificial snake skin, which imparts an intriguing look to the glove while maintaining the desired physical properties such as good wear resistance.

Figure 5:
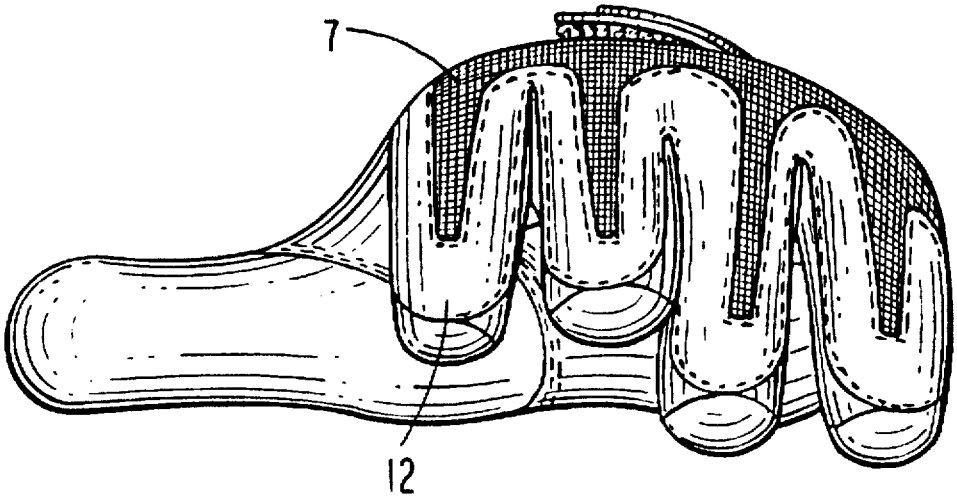
FIG. 5 is a top side view thereof.
Figure 6:
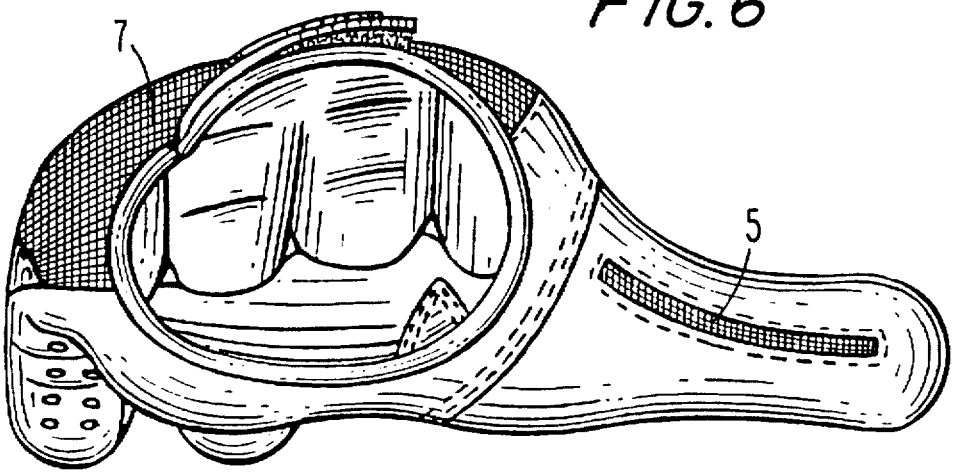
FIG. 6 is a bottom side view thereof.

FIGS. 5 and 6 depict top and bottom views of the glove according to the present invention. The elastic material 7 extending along substantially all of the finger portions of the glove can be more easily seen in FIG. 5, bounded at the fingertips by the non-woven material 12. Although it is preferred for the elastic material of the back and fingers to be of one piece, separate material for the back and fingers may be used, if desired. These materials will be joined together to the non-woven materials by sewing or the like. It is clearly seen from FIG. 6 that the elastic material 5 of the thumb is typically a separate piece of material not attached to the elastic material on the back of the glove, which overlies the bone of the thumb.

The various portions of the glove are suitably secured together, as by seams or the like.

Figure 7:
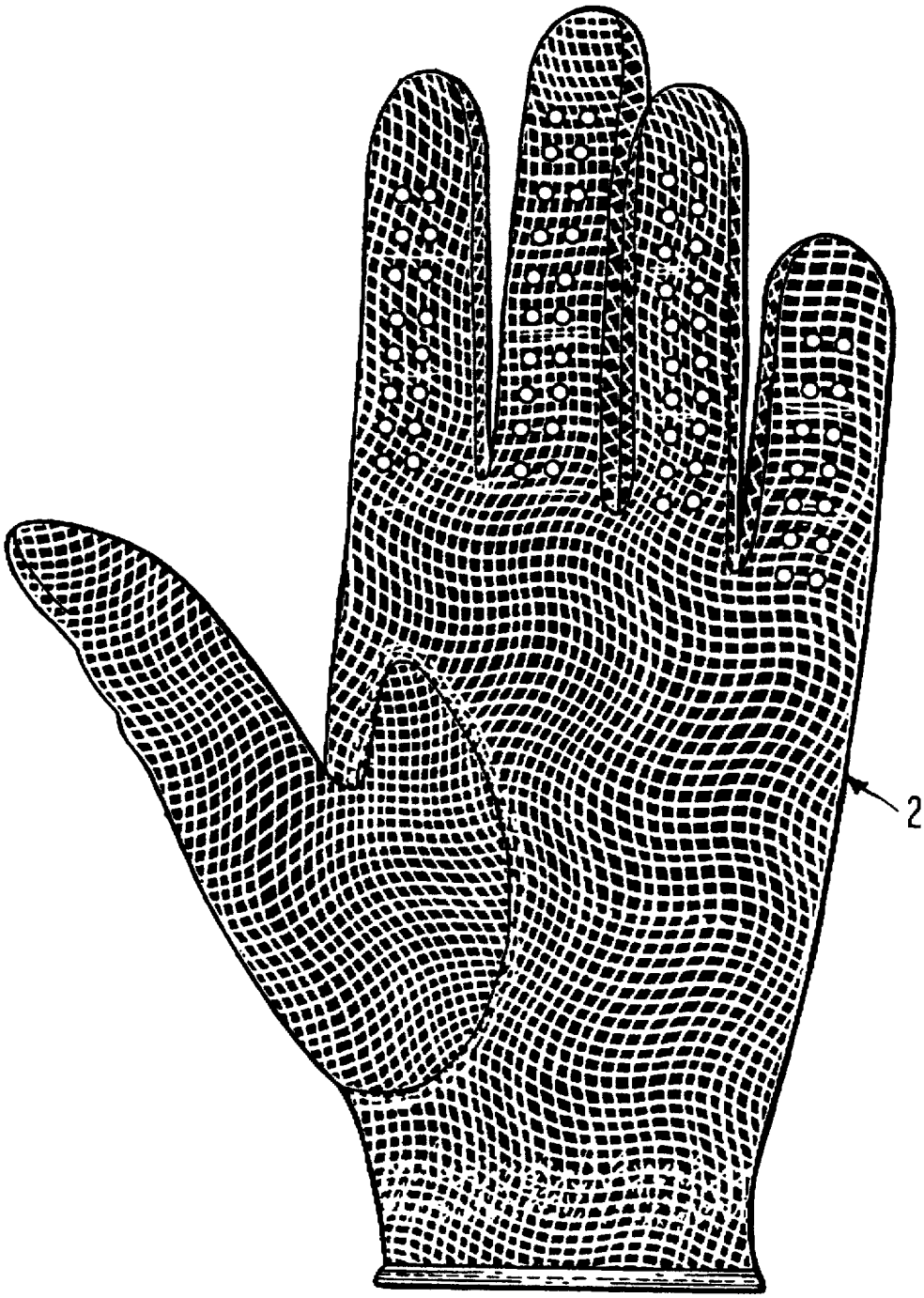
FIG. 7 is a front side view of another embodiment of the invention which uses a different leather material.
Figure 8:
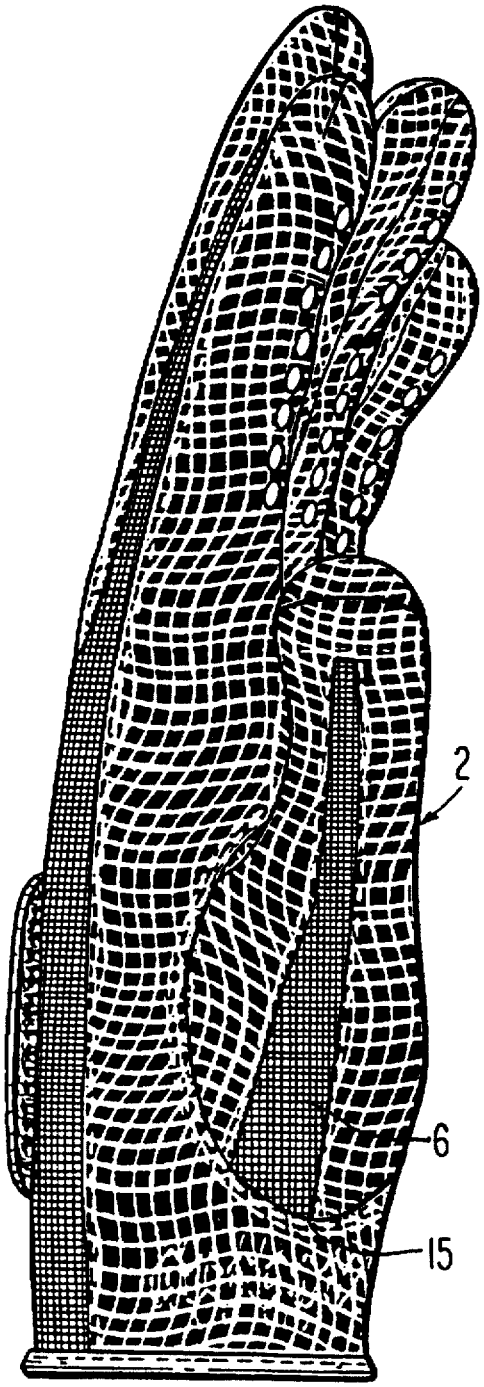
FIG. 8 is a left side view thereof.
Figure 9:
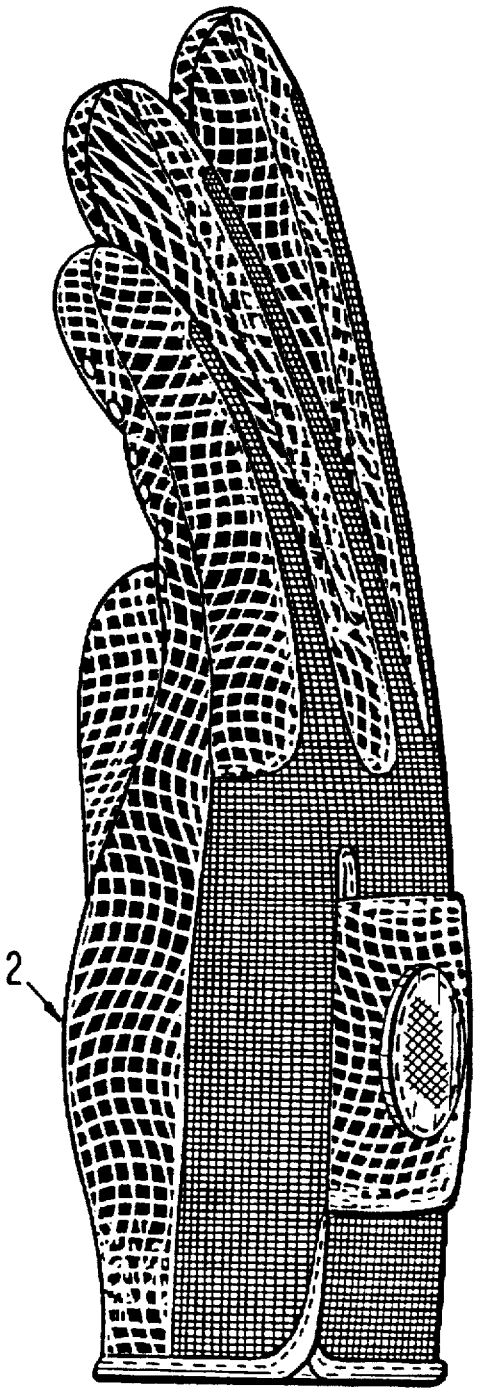
FIG. 9 is a right side view thereof.
Figure 10:
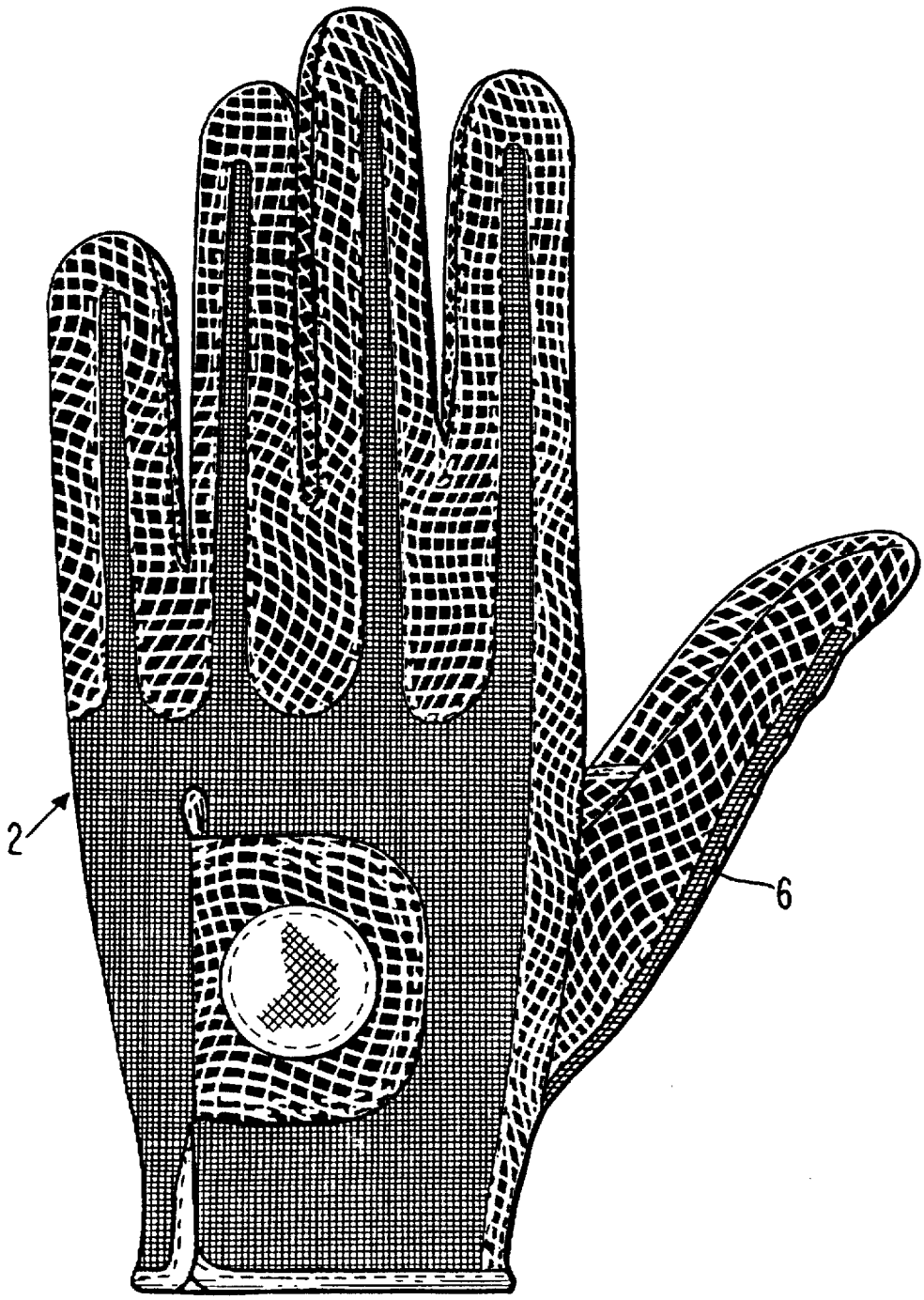
FIG. 10 is a rear side view thereof.
Figure 11:
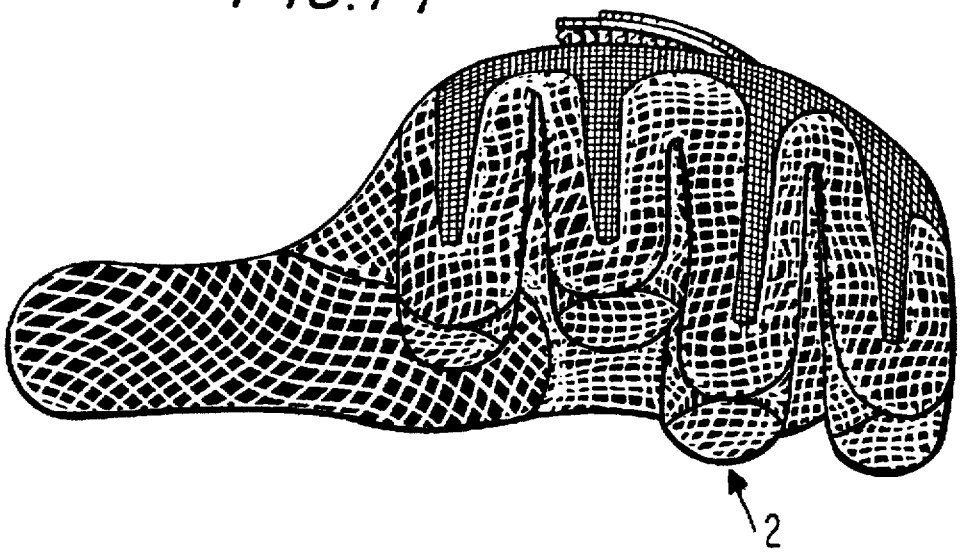
FIG. 11 is a top side view thereof.
Figure 12:
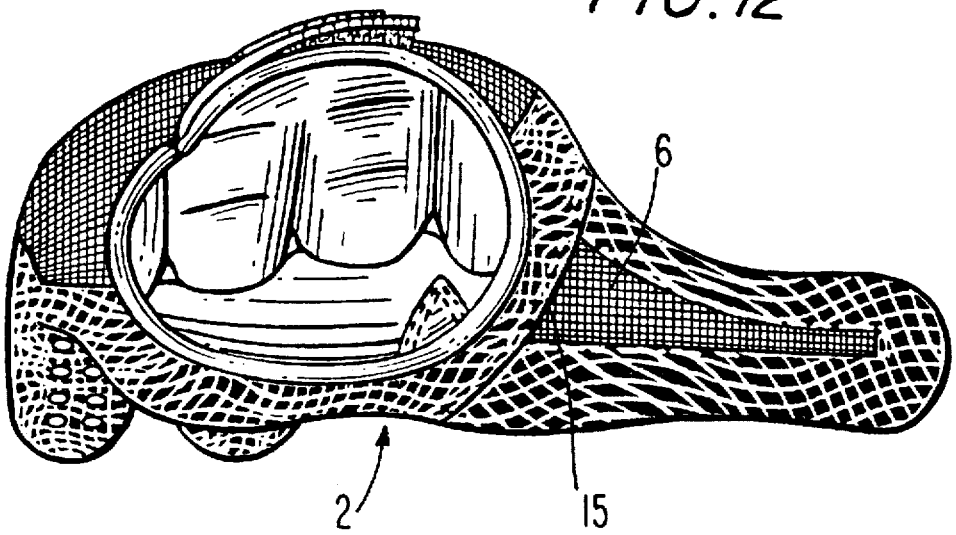
FIG. 12 is a bottom side view thereof.

FIGS. 7 to 12 are similar views of another embodiment using a particular patterned leather, such as PITTARDS DIGITAL LEATHER® in this case, as the non-woven material. FIG. 7 depicts the front of the glove 2. FIGS. 8 and 9 are side views of the glove 2. FIG. 10 is a rear side view of the glove 2. FIGS. 11 and 12 are top and bottom views of the glove 2. A different embodiment of the elastic material 5 for the thumb is depicted in FIGS. 8 and 12 as material 6. This embodiment of elastic material in the thumb extends to the base of the thumb 15. Such a wider base of material 6 permits a simpler, more cost efficient construction of the glove 2 without sacrificing the desirable qualities discussed above.

Although not depicted, several embodiments exist for the elastic material on the back of the glove that will impart additional beneficial functions. In one embodiment, fleece or other warm materials may be added to the glove back to assist the wearer in remaining warm during cold weather use. In another embodiment, seam sealing may be provided in connection with or instead of waterproof membranes in the glove to prevent leakage into the glove for use under wet conditions. In yet another embodiment, wicking materials are included in the glove that pull perspiration away from the hand to prevent sweatiness. In another embodiment, a phase change or other temperature controlling type of material, such as a ceramic, may be used to provide comfort in an extreme temperature environment. Additionally, an elastic band may be added to the palm or back covering portion of the glove, or both, to provide a snug fit of the glove on the hand at the wrist.

Another aspect of the invention is the method by which such a glove is prepared. An elastic material is typically formed into the shape desired, so that it extends across the back of the hand and extends along the backs of the fingers past and over the first knuckle in a peninsula-like shape. The formation of any of the materials may be by any such method known by those skilled in the art, for example, by cutting, tearing, and the like. This elastic material preferably looks like an overlay on the bones of the hand. Typically, a non-woven material is formed to complement the elastic material and thus, to complete substantially the entire back of the glove. The non-woven material and elastic material may be combined by attaching means, such as seams, stitching, glue, or the like.

The front of the glove is prepared in similar fashion. In a preferred embodiment, a single piece of non-woven material forms the entire front of the glove. The non-woven material must be shaped to conform to the shape of the glove, of course. In one embodiment, the back and front of the thumb form one continuous piece of material with the remainder of the back side and front side of the glove, thus obviating the need for additional attaching means. In a preferred embodiment, however, the back and front of the thumb are connected to each other and to the back and front sides of the glove, respectively, by attaching means as noted above. In either of the above embodiments, the piece of elastic material is still to be understood as being part of the thumb portion.

Various other embodiments are described below. In an optional embodiment, perforations may be created in various portions of the non-woven material to permit breathability of the wearer's hand enhanced from the breathability of the elastic material alone. In another embodiment, a single piece of non-woven material forms the entire front of the glove and wraps around to the non-woven material on the back side of the glove, thus obviating the need for attaching means. In a preferred embodiment, an elastic band of material is attached to the inside of the non-woven material of the glove at the wrist to facilitate a snug fit at the wrist.

While the present invention has been described with respect to certain specific embodiments in order to illustrate the principles thereof, other different embodiments of the invention will readily occur to those skilled in the art based upon the present teachings. The present invention should be limited, therefore, only to all those embodiments that are covered by the spirit and scope of the appended claims.

What is claimed is:

1. A glove comprising:

a palm covering portion;

a plurality of finger covering portions extending from the palm covering portion to receive and cover fingers;

a back portion associated with the palm covering portion to form a chamber to receive a hand, wherein the back portion receives the back of the hand; and elastic members extending from the back portion past and over at least one knuckle of each finger, each elastic member being associated with a finger covering portion to facilitate stretching of the finger covering portion at least at each knuckle when the finger is bent, and having a width that is less than that of the finger.

2. The glove of claim 1, wherein each elastic member has a length that extends past two knuckles of each finger.

3. The glove of claim 1, wherein the palm and finger covering portions are each made of a non-woven material.

4. The glove of claim 3, wherein the non-woven material is suede, leather or a synthetic material.

5. The glove of claim 4, wherein the non-woven leather material comprises a patterned leather.

6. The glove of claim 3, wherein the non-woven material of each finger covering portion contains a plurality of perforations to enhance breathability of the glove.

7. The glove of claim 1, wherein the back portion is made of an elastic material.

8. The glove of claim 7, wherein the elastic material of the back portion and the elastic members each comprise a mesh.

9. The glove of claim 7, wherein the elastic material of the back portion and the elastic members each comprise a material that is capable of two-way stretch.

10. The glove of claim 1, further comprising a thumb covering portion and an elastic member associated therewith to allow stretching of the thumb covering portion when the thumb is bent.

11. The glove of claim 1, wherein the palm and finger covering portions are made of a single piece of material.

12. The glove of claim 1, wherein the back portion and elastic members are made of a single piece of stretchable material.

13. The glove of claim 1, wherein the back portion includes a slit to facilitate insertion of a hand.

14. The glove of claim 1, wherein the back portion includes a closure member to close the slit after insertion of the hand.

15. The glove of claim 14, wherein the closure member is made of a non-woven material and includes an indicia thereon.

16. The glove of claim 7, wherein the elastic material includes a satin backing.

17. The glove of claim 7, wherein the elastic material includes a temperature controlling material for additional comfort.

18. The glove of claim 7, wherein the elastic material includes a waterproofing membrane.

19. The glove of claim 7, wherein the elastic material includes a wicking material to absorb perspiration.

20. The glove of claim 1, wherein the finger covering portions include an open area between adjacent finger covering portions.

21. The glove of claim 10, wherein the palm covering portion surrounds the thumb covering portion.

22. The glove of claim 1, further comprising a sretchable wrist band associated with the palm covering portion.

* * * * *